US006020874A

United States Patent [19]

Kurihara

[11] Patent Number: 6,020,874

[45] Date of Patent: Feb. 1, 2000

[54] FLAT PANEL DISPLAY DEVICE

[75] Inventor: Masahiro Kurihara, Tokyo, Japan

[73] Assignee: Kabushiki Kaisha Toshiba, Kawasaki, Japan

[21] Appl. No.: 08/936,739

[22] Filed: Sep. 25, 1997

[30] Foreign Application Priority Data

Sep. 30, 1996 [JP] Japan ..... 8-258556

[51] Int. Cl.[7] ..... G09G 5/00

[52] U.S. Cl. ..... 345/132; 345/100; 345/213

[58] Field of Search ..... 345/87, 1, 2, 99, 345/100, 132, 98; 348/490, 491, 492, 528, 529, 530; 346/213

[56] References Cited

U.S. PATENT DOCUMENTS 4,990,904 2/1991 Zenda ..... 345/3
5,406,308 4/1995 Shiki ..... 345/132
5,448,260 9/1995 Zenda et al. ..... 345/100
5,781,185 7/1998 Shin ..... 345/132
5,784,037 7/1998 Inoue ..... 345/127

*Primary Examiner*—Dennis-Doon Chow
*Attorney, Agent, or Firm*—Finnegan, Henderson, Farabow, Garrett & Dunner, L.L.P.

[57] ABSTRACT

A flat panel display device includes a display panel including a plurality of pixels arranged in matrix of rows and columns, a data latch circuit for latching various types of color data to be displayed on a display area having a predetermined resolution on the display panel, a specific color data generation circuit for generating specific color data to be displayed on a non-display area on the display panel, and a timing control circuit for controlling timing such that the specific color data generated from the specific color data generation circuit is displayed on the non-display area simultaneously with an operation of displaying the various types of color data latched by the data latch circuit on the display area.

20 Claims, 14 Drawing Sheets

DISPLAY AT VGA RESOLUTION ON XGA PANEL

DISPLAY ON CONVERTIONAL PANEL

DISPLAY AT XGA RESOLUTION ON CONVENTIONAL XGA PANEL

DISPLAY AT VGA RESOLUTION ON CONVENTIONAL XGA PANEL

DISPLAY AT VGA RESOLUTION ON CONVENTIONAL VGA PANEL

| RESOLU-TION | LARGEST NUMBER OF COLORS | REQUIRED MEMORY SIZE (KB) | REQUIRED TRANSFER RATE (KB. (1/60) SECOND) | | |
|---|---|---|---|---|---|
| | | | CONVERTIONAL DISPLAY UNIT | | |
| | | | 640×480 | 800×600 | 1024×768 |
| 640×480 | 256 | 300 | 300 | 468.75 | 768 |
| | 64K | 600 | 600 | 937.5 | 1536 |
| | 16M | 900 | 900 | 1406.25 | 2304 |
| 800×600 | 256 | 468.75 | | 468.75 | 768 |
| | 64K | 937.5 | | 937.5 | 1536 |
| | 16M | 1406.25 | | 1406.25 | 2304 |
| 1024×768 | 256 | 768 | | | 768 |
| | 64K | 1536 | | | 1536 |
| | 16M | 2304 | | | 2304 |

FIG. 7 (PRIOR ART)

DISPLAY AT VGA RESOLUTION ON XGA PANEL

DISPLAY TIMING IN C AREA

| RESOLU-TION | LARGEST NUMBER OF COLORS | REQUIRED MEMORY SIZE (KB) | REQUIRED TRANSFER RATE (KB.(1/60)SECOND) | | | |
|---|---|---|---|---|---|---|
| | | | CONVERTIONAL DISPLAY UNIT | | | DISPLAY UNIT OF PRESENT INVENTION |
| | | | 640×480 | 800×600 | 1024×768 | 1024×768 |
| 640×480 | 256 | 300 | 300 | 468.75 | 768 | 300 |
| | 64K | 600 | 600 | 937.5 | 1536 | 600 |
| | 16M | 900 | 900 | 1406.25 | 2304 | 900 |
| 800×600 | 256 | 468.75 | | 468.75 | 768 | 468.75 |
| | 64K | 937.5 | | 937.5 | 1536 | 937.5 |
| | 16M | 1406.25 | | 1406.25 | 2304 | 1406.25 |
| 1024×768 | 256 | 768 | | | 768 | 768 |
| | 64K | 1536 | | | 1536 | 1536 |
| | 16M | 2304 | | | 2304 | 2304 |

FIG. 14

FLAT PANEL DISPLAY DEVICE

BACKGROUND OF THE INVENTION

The present invention relates to a flat panel display device employing a flat display panel such as an LCD (Liquid Crystal Display), a plasma display, an EL (Electronic Luminescence) display and an FED (Field Emission Display).

A TFT (Thin Film Transistor) color LCD panel is known as a typical flat display panel used as a display for computers or the like. In this TFT color LCD panel, display data for one display line are input from a display controller to a plurality of source drivers and then supplied therefrom to all source electrode lines at once, thereby displaying the data. The display data are supplied in sequence to the source drivers from the left to the right.

This data input method in which display data are supplied first to the leftmost source driver, is applied not only when data is displayed on the entire liquid crystal display section but also when data is displayed on part of the display section. Therefore, as shown in FIG. 1, even when data is displayed on a liquid crystal display section 500 at a resolution lower than the highest resolution, the data has to be transmitted from a display controller to the entire liquid crystal display section 501 (all dots including those not used for display). Thus, the display controller necessitates operating in timing necessary for display the data on the entire display section even though the data is displayed within a smaller display area 502 than the entire display section.

FIG. 2 illustrates the constitution of a prior art TFT panel unit.

In FIG. 2, input data of respective source drivers are digital signals of R, G and B, while output data thereof are analog signals of R, G and B. When each source driver receives a signal Spi, which indicates the start of data input, from a driver controller 513, it starts to supply the input data to a shift register for each of clock signals Ck. When the source driver receives a data output signal Ls, it outputs data to the shift register.

When the source drivers other than the final one input data to their own shift registers, they output a signal Spo indicative of the end of data input. The output signal Spo of a source driver other than the final one corresponds to an input signal Spi of the next source driver.

When a gate driver receives the signal Spi, it starts to apply a voltage (in sequence from the first line) to each of display lines of a liquid crystal display section in response to each scan signal Cls. All transistors of one line to which the voltage is applied are turned on.

Each of the gate drivers other than the final one outputs a signal Spo when it applies a voltage to its own last display line. The output signal Spo of the gate driver corresponds to an input signal Spi of the next gate driver.

FIG. 3 illustrates the internal structure of each source driver of the prior art TFT panel unit.

When a count circuit 601 receives a signal Spi, it outputs a signal CK' whenever its subsequent signal CK rises (or falls). The count circuit 601 counts the rise (or fall) of the signal CK. If the signal CK is input by the same number as that of shift registers, the circuit 601 stops outputting the signal CK' and outputs signal Spo.

When a data latch circuit 602 receives a signal CK', it latches signal DATA between high and low and continues to output the latched data as "DATA'" until the next signal CK' is input.

The shift register 603 has a plurality of registers (data storage sections). For example, when eight source drivers are employed in 1024×768 panels, the number of registers of the shift register in one source driver is 1024/8=128. Upon receiving the signal CK', the shift register 603 shifts stored data to its left register and, in this case, DATA' in the left-most register is deleted and new DATA' is stored in the rightmost register.

A voltage selection and application circuit 604 receives a signal Ls and applies one of voltages V0 to V7 to the lines corresponding to the data stored in the plural registers of the shift register 603.

FIGS. 4 to 6 show three cases of display operation timing of the prior art TFT panel.

In the case of FIG. 4, data is displayed at XGA resolution (1024×768 dots) on a panel having XGA resolution of 1024×768 dots. Eight source drivers are employed and correspond to those of FIG. 2 to which SD1 to SD8 are assigned in sequence from the left.

In FIG. 4, vertical sync signal Vsync, horizontal sync signal Hsync, display data DATA, and shift clock SHFCLK by which transfer timing of display data DATA is represented in unit of dots, are output signals of a display controller (alongside the computer body). The mesh portions indicate variations in signal levels H and L. SD1 INPUT to SD8 INPUT are input signals (input DATA) of the eight source drivers. In FIG. 4, A denotes timing in which signal Spi is input to the source driver DS1, B shows timing in which signal Spo is output from the source driver SD1 and signal Spi is input to the source driver SD2, and C indicates timing in which signal Ls is input to the source drivers SD1 to SD8. As described above, in the prior art panel, a plurality of source drivers do not receive data at the same time.

In the case of FIG. 5, data is displayed at VGA resolution (640×480 dots) on a panel having XGA resolution of 1024×768 dots. Vsync, Hsync, DATA and SHFCLK are output signals of the display controller, and the operation timing is the same as that of FIG. 4. The black portions of DATA represent timing in which the display controller outputs specific color data (e.g., black data which shows that R, G and B signals are all "0."). The black portions of SD1 INPUT to SD8 INPUT represent timing in which the specific color data is input to the shift register. More specifically, specific color data of 128 dots is input to the left-most and rightmost source drivers SD1 and SD8. Of data of 128 dots input to the source driver SD2, data of left-handed 64 dots is specific color data. Of data of 128 dots input to the source driver SD7, data of right-handed 64 dots is also specific color data.

In FIG. 6, data is displayed at VGA resolution (640×480 dots) on a panel having VGA resolution of 640×480 dots. Five source drivers are employed and correspond to those of FIG. 2 to which SD1 to SD5 are assigned in sequence from the left. Vsync, Hsync, DATA and SHFCLK are output signals of the display controller, and SD1 INPUT to SD5 INPUT are input data of the five source drivers SD1 to SD5.

Comparing FIGS. 4 and 5, it is seen that the frequencies of SHFCLK and Hsync are decreased, for the resolution of the panel is low.

As described above, conventionally, even when part of an LCD section is used for displaying data, the operation speed and timing of the display controller are the same as those when the whole LCD section is used therefor and, in the remaining part of the LCD not used for displaying data, specific color data has to be sent to an LCD panel from the display controller. When part of the LCD panel is employed, the display controller has to operate at the same speed as that when the entire LCD panel is used. For this reason, in the prior art, the maximum number of colors, which can be displayed on part of the LCD panel, is restricted. For example, if the following restrictions are placed on the display controller, data of the hatched portions of FIG. 7 cannot be displayed.

Memory capacity for displaying data: 2 MB or less
Transfer Rate: 2 MB or less per 1/60 seconds.

If a prior art 640×480 panel is connected to the display controller, 16M colors can be displayed to the maximum. If, however, data is displayed by 640×480 dots using part of the prior art 1024×768 panel, the maximum number of colors which can be displayed will be 64K and is smaller than that when the 640×480 panel is used.

Consequently, in the prior art 1024×768 panel, 16M colors cannot be displayed by 800×600 dots or 640×480 dots.

BRIEF SUMMARY OF THE INVENTION

Accordingly, it is an object of the present invention to provide a flat panel display device in which when data is displayed at a resolution lower than the maximum displayable resolution, a display controller is operated at lower speed than when data is displayed at the maximum displayable resolution, and the maximum number of colors of the data displayed at the lower resolution can be increased more than that of colors of data displayed at the maximum resolution.

According to one aspect of the present invention, there is provided a flat panel display device comprising a display panel including a plurality of pixels arranged in matrix of rows and columns, a data latch circuit for latching various types of color data to be displayed on a display area having a predetermined resolution on the display panel, a specific color data generation circuit for generating specific color data to be displayed on a non-display area on the display panel, and a timing control circuit for controlling timing such that the specific color data generated from the specific color data generation circuit is displayed on the non-display area simultaneously with an operation of displaying the various types of color data latched by the data latch circuit on the display area.

In the flat panel display device, the timing control circuit may start to display the specific color data on the non-display area simultaneously with the start to display the various types of color data on the display area. The timing control circuit may include means for detecting a resolution of the display area on the display panel. The timing control circuit may include means for recognizing a boundary between the display area and the non-display area on the display panel based on the resolution detected by the resolution detecting means.

The display panel may include a plurality of column drivers for driving a plurality of column electrodes of the display panel and a plurality of row drivers for scanning row electrodes of the display panel for each of rows.

The plurality of row drivers may scan continuous display lines of the non-display area to which all the pixels belong, at a higher speed than display lines of the display area. Each of the plurality of column drivers may include means for generating the specific color data. The flat panel display device may further comprise means for changing the specific color data generated from the specific color data generating means.

The timing control circuit may include means for causing column drivers of the plurality of column drivers, which correspond to the non-display area, to display the specific color data on the non-display area. The timing control circuit may include means for supplying each of the plurality of column drivers with a first control signal indicating whether the specific color data is to be displayed. In this case, the each of the plurality of column drivers may include means for determining whether the specific color data is to be displayed in response to the first control signal.

The timing control circuit may include means for causing only column drivers of the plurality of column drivers, which correspond to the display area, to display the various types of color data in sequence on the display area. The timing control circuit may include means for supplying each of the plurality of column drivers with a second control signal indicating whether an enable signal received from a preceding column driver is to be transferred to a succeeding column driver. In this case, each of the plurality of column drivers may include means for determining whether the enable signal received from the preceding column driver is to be transferred to the succeeding column driver, in response to the second control signal.

The specific color data to be displayed on the non-display area may be black data.

According to another aspect of the present invention, there is provided a method of displaying color data on a display panel including a plurality of pixels arranged in matrix of rows and columns, comprising the steps of latching various types of color data to be displayed on a display area having a predetermined resolution on the display panel, generating specific color data to be displayed on a non-display area on the display panel, and controlling timing such that the specific color data is displayed on the non-display area simultaneously with an operation of displaying the various types of color data latched on the display area.

The method may further comprise a step of starting to display the specific color data on the non-display area simultaneously with the start to display the various types of color data on the display area. The method may further comprise a step of detecting a resolution of the display area on the display panel. The method may further comprise a step of recognizing a boundary between the display area and the non-display area on the display panel based on the detected resolution. The method may further comprise a step of scanning continuous display lines of the non-display area to which all the pixels belong, at a higher speed than display lines of the display area.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 7 is a table showing a relationship between the resolution of data displayed according to the prior art display method and the number of colors of the displayed data;

FIG. 14 is a table showing a relationship between the resolution of data displayed on the flat panel display device of FIG. 8 and the number of colors of the displayed data.

DETAILED DESCRIPTION OF THE INVENTION

An embodiment of the present invention will now be described with reference to the accompanying drawings.

Figure 8:
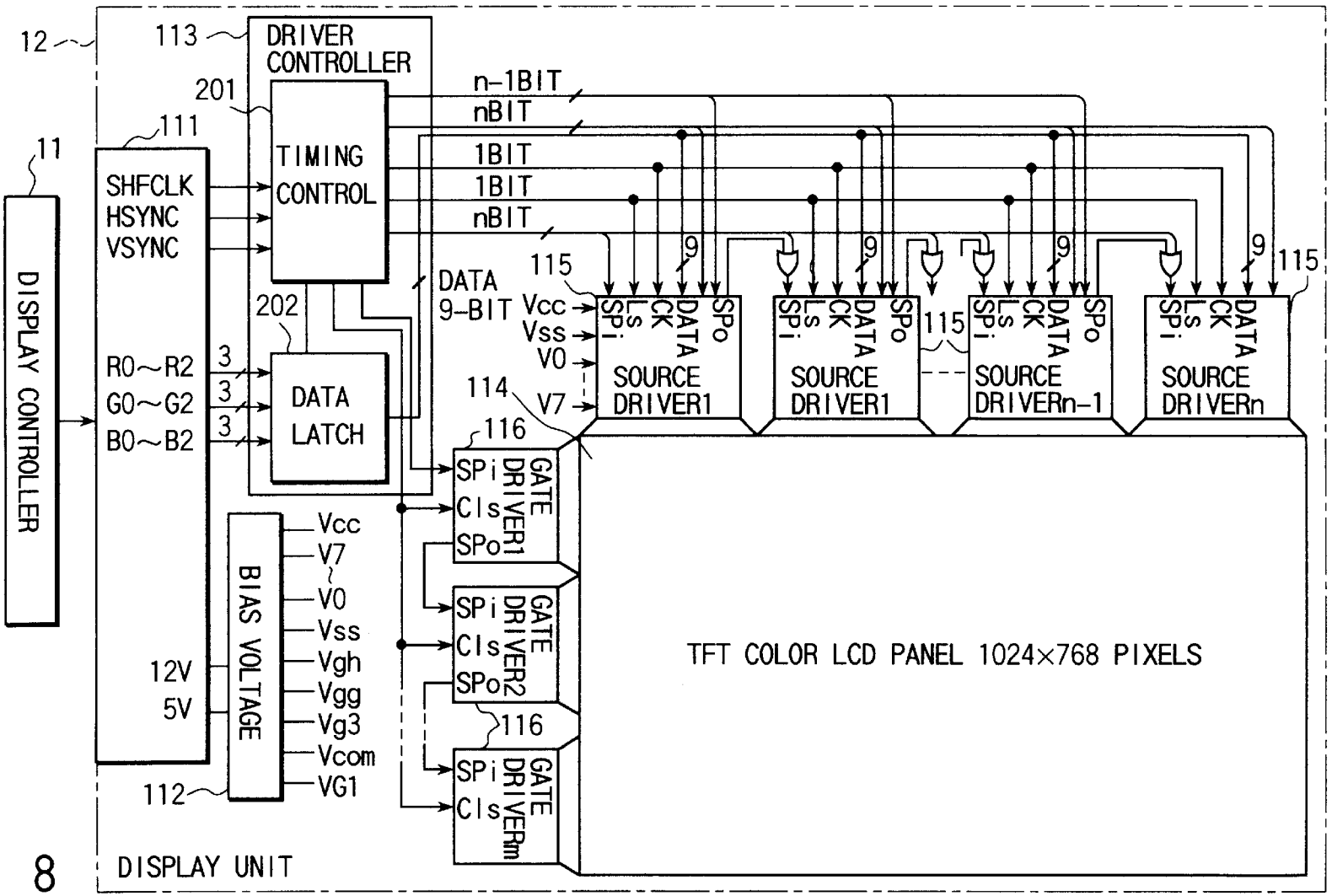
FIG. 8 is a block diagram of the constitution of a flat panel display device according to one embodiment of the present invention.

FIG. 8 illustrates a flat panel display device according to the embodiment of the present invention. The device is constituted of a display controller 11 of a computer and a display unit 12 used as a display monitor of the computer. The display unit 12 includes a connector 111, a bias voltage generation circuit 112, a driver controller 113, a TFT LCD panel section 114, n source drivers (i.e., column drivers) 115, and m gate drivers (i.e., row drivers) 116. The driver controller 113 produces various types of timing signals for controlling the source and gate drivers 115 and 116, and the timing signals are issued in accordance with the relationship between the resolution of the LCD panel section 114 and that of data to be actually displayed. The latter resolution is computed by a timing control circuit 201 based on Vsync, Hsync, SHFCLK, etc. supplied from the display controller 11.

The source drivers (i.e., column drivers) 115 drive source electrodes (i.e., column electrode) of the LCD panel section 114 and each includes a shift register for receiving and holding display data. On the other hand, the gate drivers (i.e., row drivers) 116 scan gate electrodes (i.e., row electrodes) of the LCD panel section 114 for each of rows. Each of the source drivers 115 has the following four control signals which are the same as those of the prior art:

(1) Ls . . . input from timing control circuit 201;

(2) CK . . . input from timing control circuit 201;

(3) Spi . . . input from timing control circuit 201 and the left source driver;

(4) Spo . . . output to the right source driver;

(5) SPo ENABLE . . . input from timing control circuit 201; and (6) DATASET . . . input from timing control circuit 201.

The Spo ENABLE is a signal for indicating whether the signal Spo is to be output to the right source driver or not. The source driver supplied with the signal Spo ENABLE supplies the signal Spo to the right source driver when data is set in the shift register (described later) of the source driver.

DATASET is a control signal for instructing the source driver to ignore "various types of color data" from the display controller 11, which is to be displayed as characters or images on display area, and to generate and hold "specific color data (e.g., black data)" which is to be outputted to "non-display area". The source driver supplied with DATASET outputs the specific color data onto its corresponding source electrode when signal Ls is input.

The various types of color data and control signals Ls and CK are input in common to all the source drivers. The number of control signals Spi corresponds to that of n source drivers 115, and each of the control signals is input to its corresponding one of the source drivers from the timing control circuit 201. As for each of the second source driver and its subsequent ones, the control signal is input from the timing control circuit 201 and the left source driver through an OR circuit. In the connection of such control signals Spi, the input of the various types of color data can be started from any of the source drivers.

The number of control signals DATASET also corresponds to that of n source drivers 115, and each of the control signals is input to its corresponding one of the source drivers from the timing control circuit 201. The specific color data can thus be set to an arbitrary one of the source drivers. When the specific color data is set, each source driver applies a predetermined voltage (e.g., 0 V indicative of black) to a series of electrode lines corresponding to three dots of R, G and B constituting one pixel. In other words, the source driver supplied with DATASET is set in which state the specific color data is output.

(1) Each source driver inputs various types of color data to the shift register from its left end for every control signal CK when the signal Spi is input.

(2) Each source driver generates specific color data of a predetermined value indicating specific color (e.g., black) and holds it in the shift register in place of inputting various types of color data when the control signal DATASET is on. Since the output signal Spo of one of the source drivers except for the rightmost one is equal to the input signal Spi of its right source driver, if the input signal Spo ENABLE of the one of the source drivers is on, data can be continuously supplied to the right side source driver therefrom.

(3) When DATASET is off, the source driver receives the various types of color data and holds it in the shift register.

(4) If data is input to rightmost space of the shift register and Spo ENABLE is on, the source driver outputs signal Spo. The output signal Spo of one of the source drivers except for the rightmost source driver corresponds to the input signal Spi of its right source driver. If, therefore, the input signal Spo ENABLE of the one of the source drivers is on except for the rightmost source driver, data can continuously be set from the one of the source drivers to right side source driver.

(5) If data is input to the shift register of the rightmost source driver and Spo ENABLE is off, the source driver does not output signal Spo.

(6) Upon receiving a signal Ls, the source driver sends all the display data DATA to the LCD section.

Figure 9:
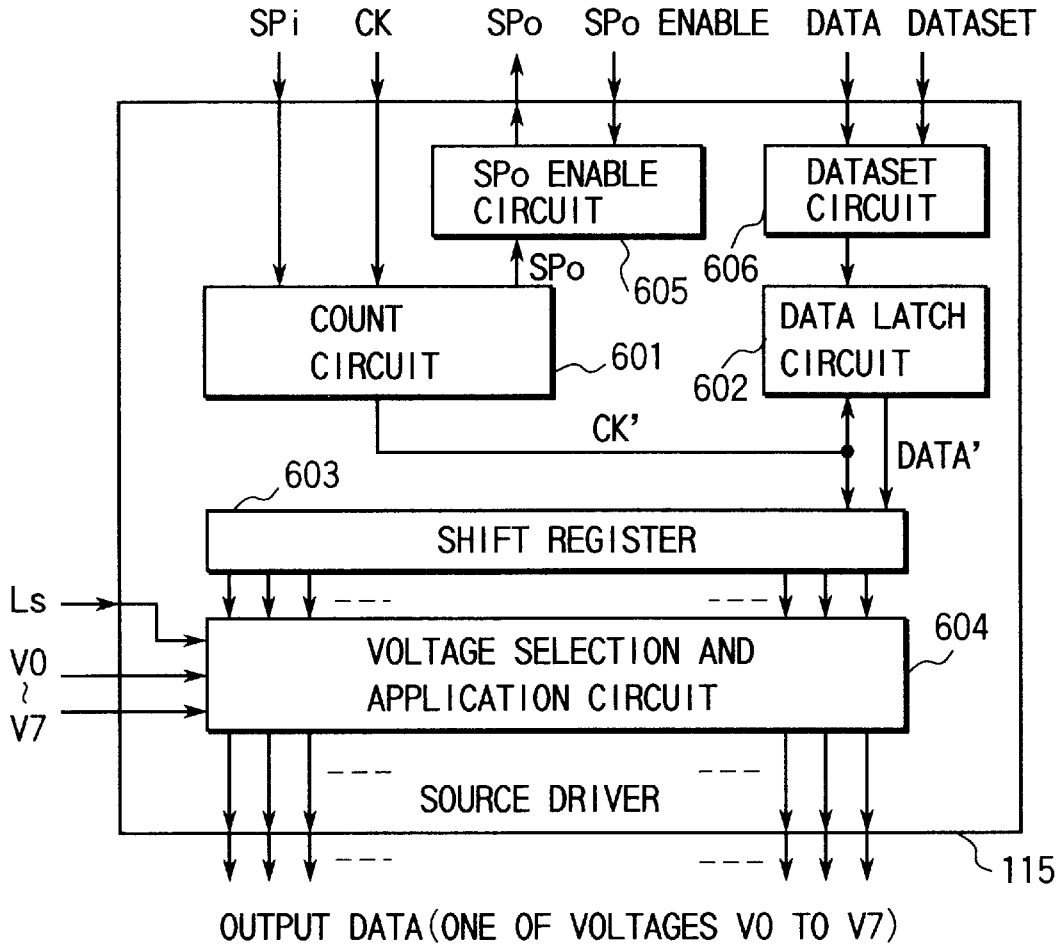
FIG. 9 is a block diagram of the internal constitution of a source driver of the flat panel display device illustrated in FIG. 8.

FIG. 9 illustrates the internal constitution of each of the source drivers according to the above embodiment.

Figure 1:
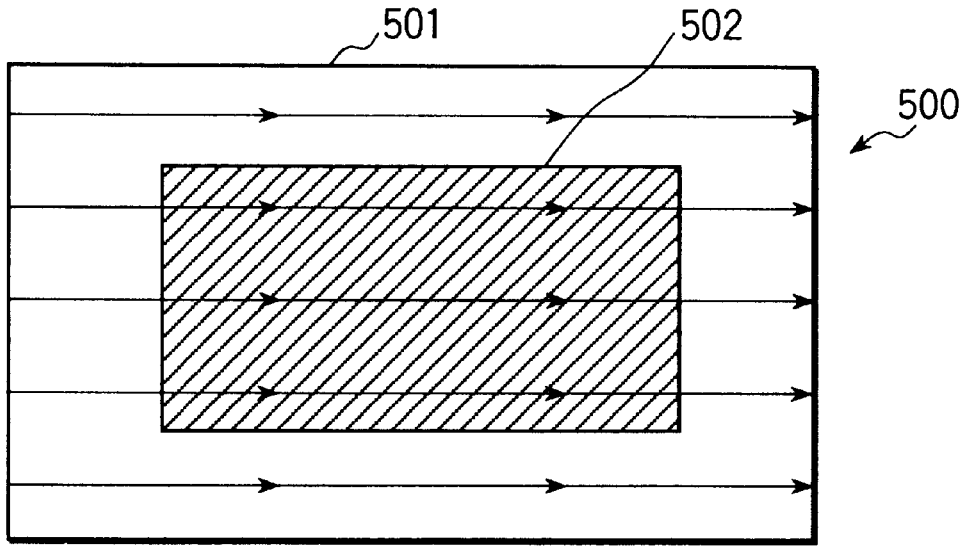
FIG. 1 (PRIOR ART)
FIG. 1 is a view for explaining the principle of a prior art flat panel display device.
Figure 2:
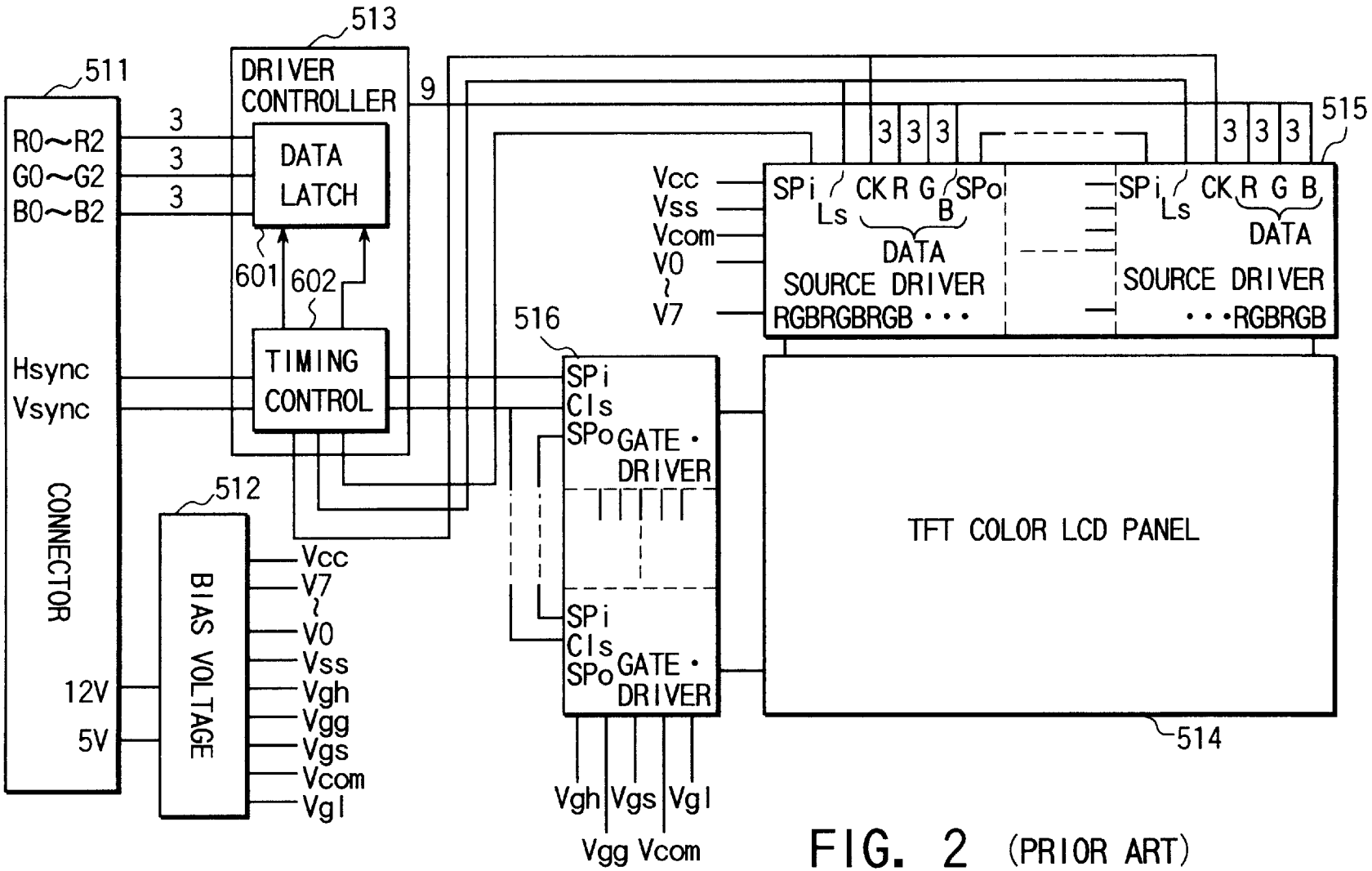
FIG. 2 (PRIOR ART)
FIG. 2 is a block diagram of the constitution of a prior art display panel.
Figure 3:
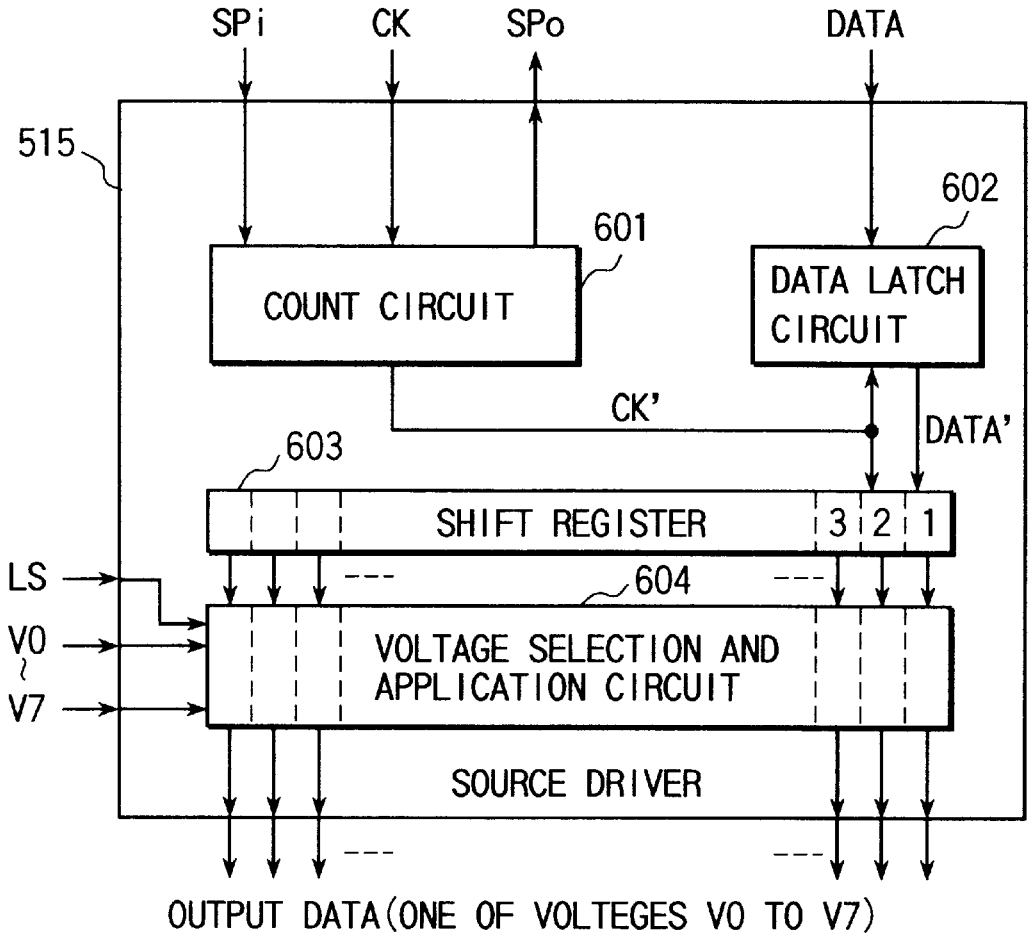
FIG. 3 (PRIOR ART)
FIG. 3 is a block diagram of the internal constitution of a prior source driver.
Figure 4:
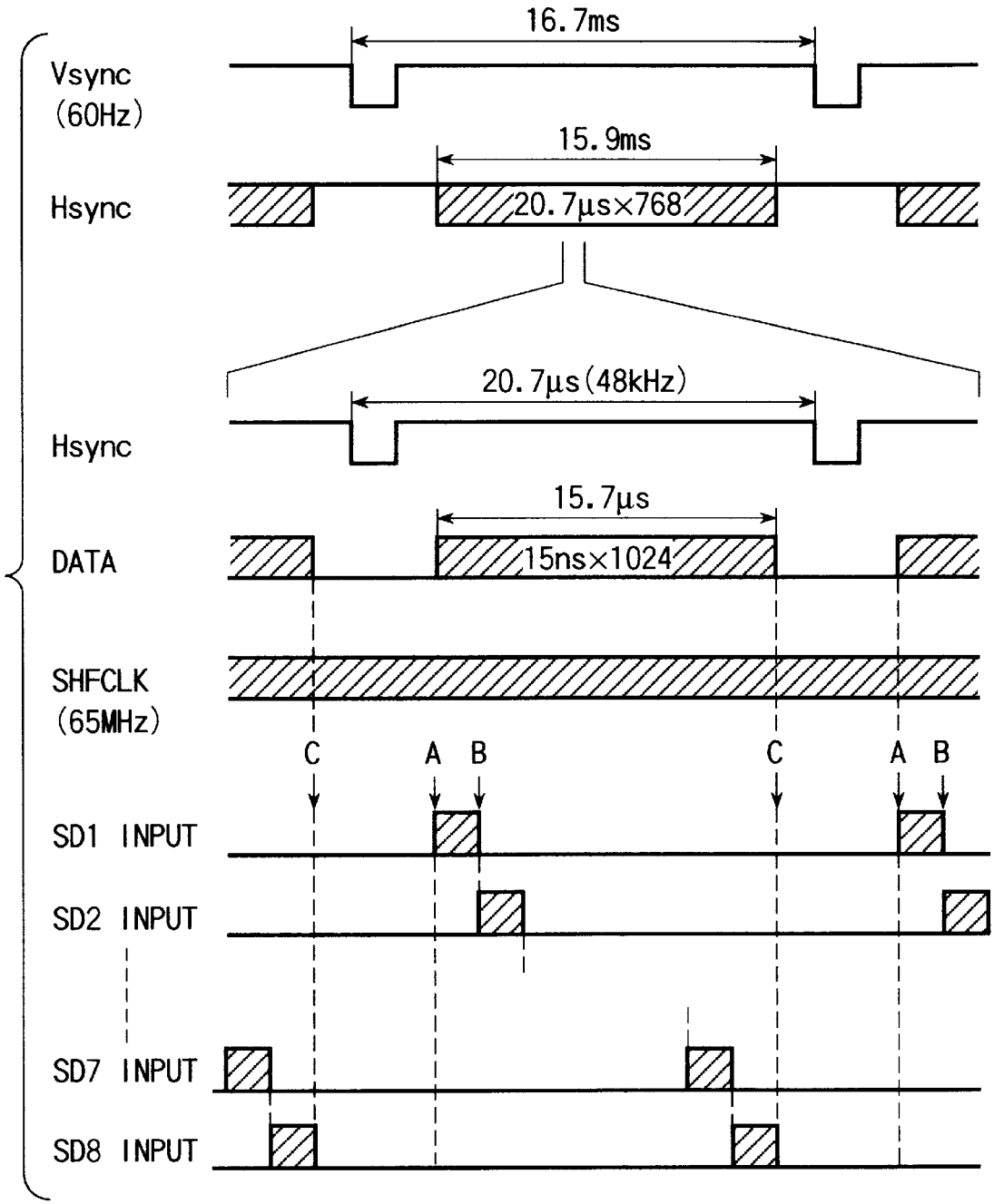
FIG. 4 (PRIOR ART)
FIG. 4 is a timing chart showing a display operation of the prior art display panel.
Figure 5:
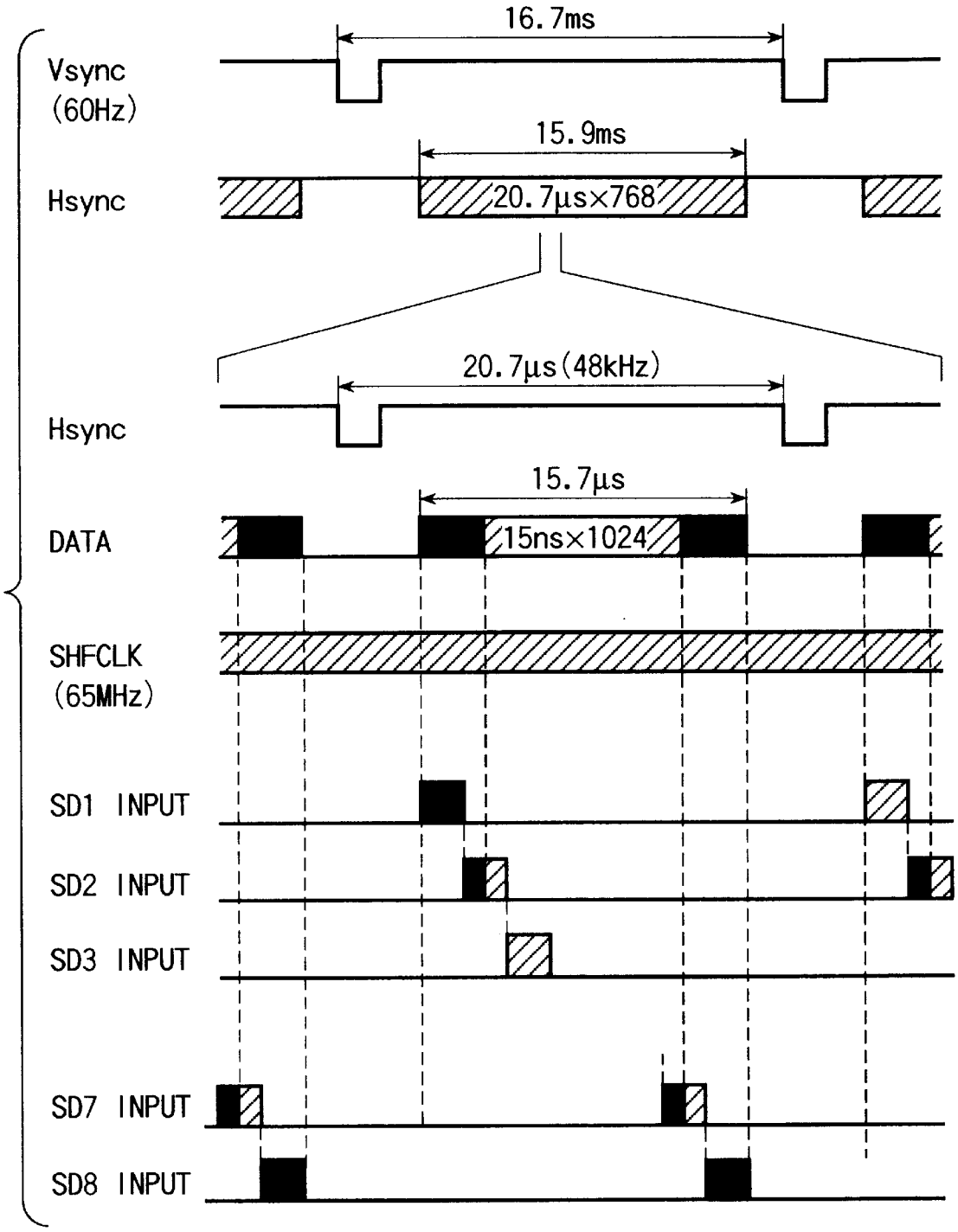
FIG. 5 (PRIOR ART)
FIG. 5 is a timing chart showing another display operation of the prior art display panel.

The source driver is constituted by adding an Spo ENABLE circuit 605 and a DATASET circuit 606 to the prior art source driver shown in FIG. 3. The descriptions of count circuit 6, data latch circuit 602, shift register 603 and voltage selection and application circuit 604 will be omitted and hereinafter only the circuits 605 and 606 will be described.

The Spo ENABLE circuit 605 outputs input signal Spo as it is only when it is supplied with signal Spo ENABLE, and stops outputting input signal Spo and outputs no signals when it is not supplied with Spo ENABLE. The Spo ENABLE circuit 605 can be constituted only by an AND circuit.

The DATASET circuit 606 outputs the input various types of color data as it is when it is not supplied with signal DATASET, and ignores input signal DATA and generates and outputs the specific color data when it is supplied with signal DATASET.

The foregoing source driver is initialized when it is started, and the specific color data is input to a register (not shown) of the DATASET circuit 606. The specific color data is thus displayed when the source driver is started.

Figure 10:
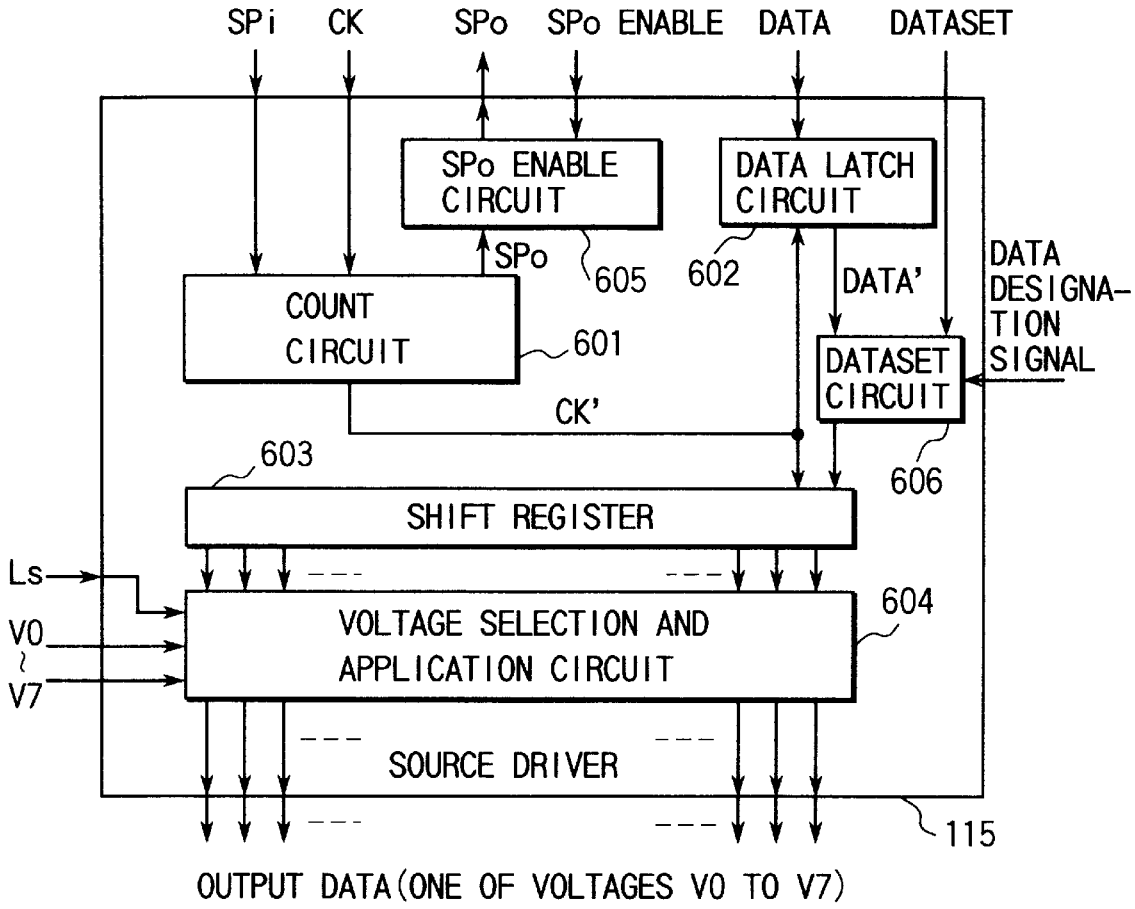
FIG. 10 is a block diagram showing a modification to the source driver of FIG. 9.

FIG. 10 is a modification to the source driver described above of FIG. 9.

The source driver of FIG. 10 differs from that of FIG. 9 in connecting position of DATASET circuit 606. The source driver of FIG. 10 is so constituted that a DATA designation signal can be input to the DATASET circuit 606. In this source driver, unlike in that of FIG. 9, the specific color can freely be changed.

As is evident from the above, the source driver of the present invention has the advantage of being easily manufactured by simply adding the Spo ENABLE circuit and DATASET circuit to the prior art source driver.

An operation of the flat panel display device of the above embodiment will now be described specifically with reference to FIG. 11.

Figure 11:
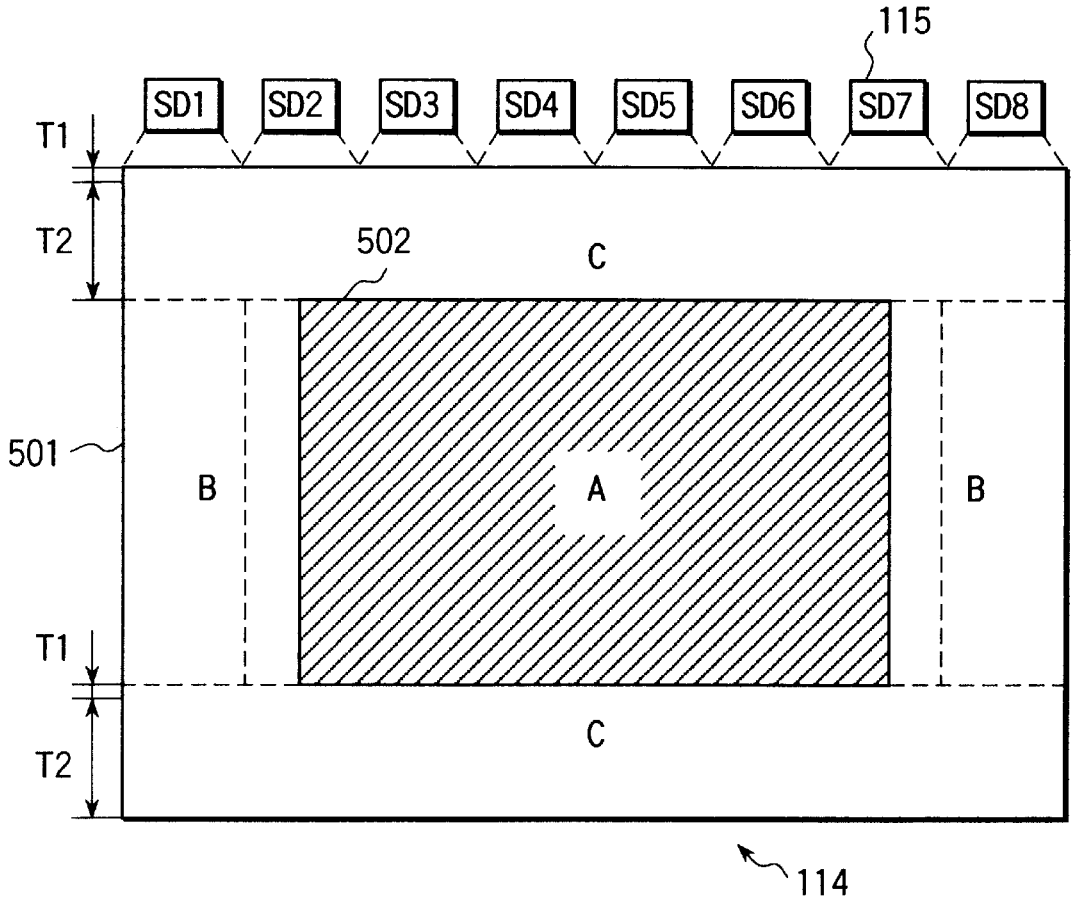
FIG. 11 is a view showing a relationship between a display area and a non-display area when data is displayed at a lower resolution than the maximum resolution displayable in the flat panel display device of FIG. 8.

As shown in FIG. 11, the TFT LCD panel section 114 has a resolution of 1024×768 dots, and data is displayed at a resolution of 640×480 dots. In the panel section, A is a display area, while B and C are non-display areas.

The device has eight source drivers SD1 to SD8, and each of the source drivers drives a source electrode line corresponding to 128 pixels.

The boundary between the areas A and C is that between a source driver including the display area and a source driver not including it. The bottom ends of the areas A and B correspond to that of the display area, regardless of the boundary of gate drivers.

(1) Since the source driver of the area B writes data to its shift register at the same time when the source driver of the area A writes data to its shift register, the time required for writing data of one line is A/(A+B) as long as that in the prior art case. It is thus possible to decrease the speed at which the display controller outputs data in the horizontal direction.

(2) Since, in the area C, the source drivers write the specific color data to their shift registers at once, the time required for writing data of one line is 1/(the number of source drivers) as long as that in the prior art case. Furthermore, the area C includes continuous display lines on which all pixels are not displayed. If, in order to display the uppermost line, the specific color data is written and afterwards signals Cls are continuously input, the write time for the second line and its subsequent lines can be omitted and, in this case, the same data output to the uppermost line of the area C is output to the second lines et seq. Consequently, the speed at which the display controller 11 outputs data in the vertical direction, can be decreased.

Figure 12:
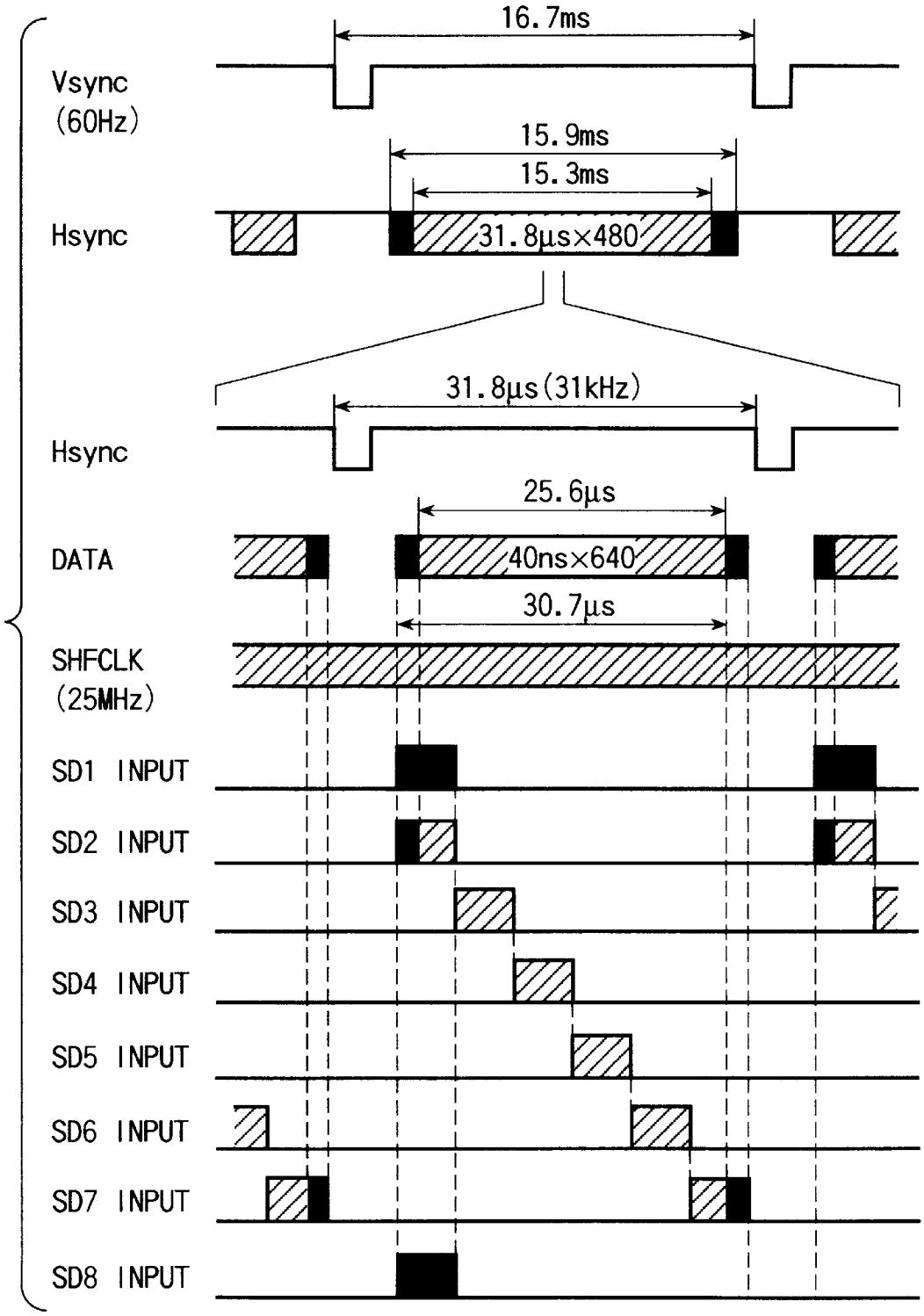
FIG. 12 is a timing chart showing a display operation of the flat panel display device of FIG. 8.

FIG. 12 shows timing of the display as described referring to FIG. 11, that is, timing of data displayed at a VGA resolution (640×480 dots) on the panel having an XGA resolution of 1024×768 dots.

Figure 6:
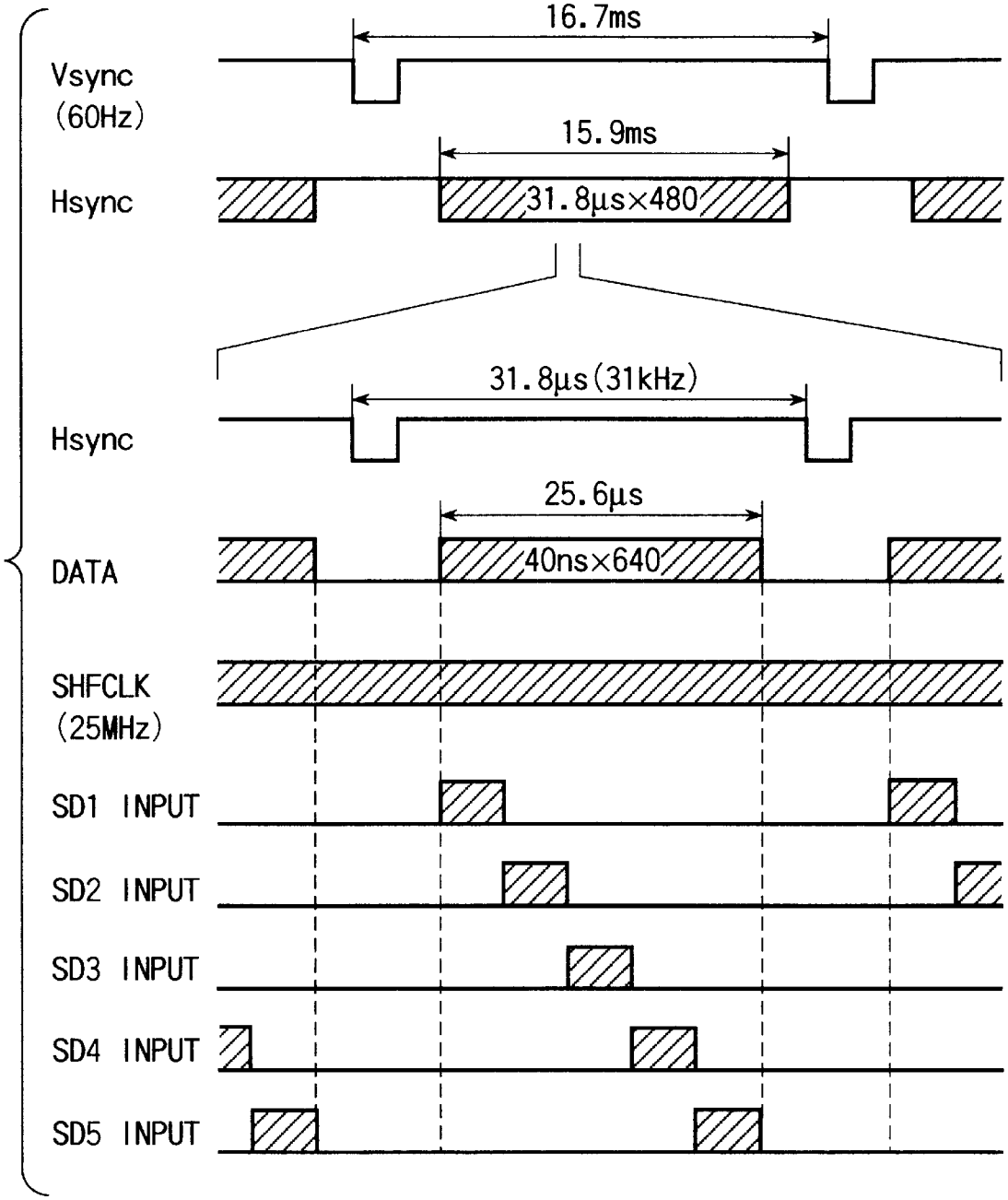
FIG. 6 (PRIOR ART)
FIG. 6 is a timing chart showing still another display operation of the prior art display panel.

In FIG. 12, Vsync, Hsync, DATA and SHFCLK are output signals of the display controller 11. The timings other than that of DATA are the same as that of data displayed by VGA size on the VGA panel, as described referring to FIG. 6.

The timing control circuit 201 checks the resolution of data to be displayed by the signals Vsync, Hsync, DATA and SHFCLK, and recognizes the positions of display areas A, B and C as described with reference to FIG. 11. More specifically, the area C includes continuous non-display lines in the upper and lower portions of the entire panel, and the source drivers SD1 to SD8 all correspond to the non-display areas in the area C. Furthermore, in the area A, the source drivers SD1 and SD8 correspond to the non-display areas, while the source drivers SD2 to SD7 correspond to the display areas. At the same time, it is determined that the source drivers SD2 and SD7 correspond to both the display and non-display areas.

Since in the area A the source drivers SD1 and SD8 correspond to the non-display area (B) and the source drivers SD2 to SD7 correspond to the display area (A), the signal DATASET is input to the source drivers SD1 and SD8 of the area B, and the signal Spi is input to the leftmost one of the source drivers SD2 to SD7 of the area A. The signals Spo ENABLE output from the source drivers SD2 to SD6 are turned on. Consequently, the specific color data can be input to the shift registers of the source drivers SD1 and SD8 corresponding to the area B at the same time when the various types of color data is input to the shift registers of the source drivers SD2 to SD7 corresponding to the area A.

As for the source drivers SD2 and SD7 corresponding to both the display and non-display areas, the specific color data is input to those portions of the shift registers thereof which correspond to the non-display area. This is achieved by. outputting a predetermined value (e.g., "0") as data of R, G and B at regular intervals before and after display data DATA is output.

Figure 13:
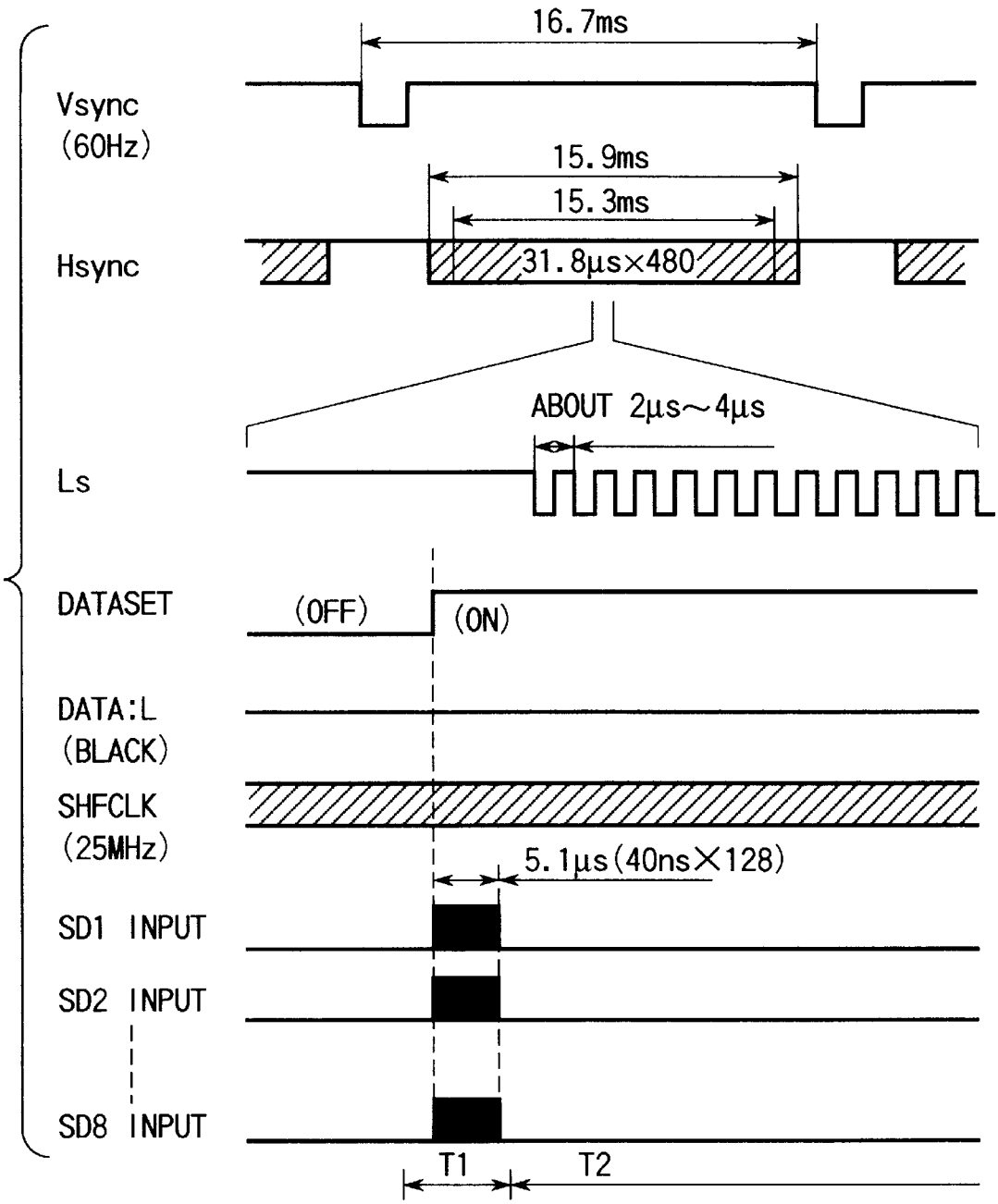
FIG. 13 is a timing chart showing a display operation of the flat panel display device of FIG. 8.

The display timing of the area C of FIG. 11 will now be described with reference to FIG. 13.

T1: First, the eight source drivers are operated simultaneously at the beginning of the area C, and the specific color data is input to the shift register of these source drivers. This operation is achieved by turning on the signal DATASET corresponding to all the source drivers.

T2: Then, Ls (input signal of a source driver) and Cls (input signal of a gate driver) are input in sequence and data (voltage) is output to the area C. The same data is output by the number of horizontal lines by repeatedly using input data in T1.

The signal DATASET remains in an on-state while data (voltage) is being output to the area C; accordingly, the data stored in the shift registers remains the specific color. Since, therefore, data of the shift registers of all the source drivers are not updated, the screen can be scanned in a shorter time than in the prior art case by continuously supplying the input signals Ls to the source drivers. In other words, the timing of Cls in the area C can be set quicker than in the area B, like that of Ls.

As described above, according to the foregoing embodiment of the present invention, when the various types of color data is to be displayed at a resolution lower than the maximum resolution displayable on the TFT LCD panel 114, the data corresponding to one display line of the display screen of the low resolution starts to be input to the source driver SD2 of the source drivers SD2 to SD7 corresponding to the area A on the panel 114. Not the data from the display controller 11 but the specific color data is set to the source drivers SD1 and SD8 corresponding to the non-display area B of the panel 114. The specific color data can thus be set in parallel with the transfer of display data for one display line corresponding to the low-resolution display screen. Consequently, the display controller 11 has only to transfer such various types of color data and can be operated in timing later than operation timing necessary for transferring data corresponding to the maximum resolution displayable on the display panel. For example, as in the foregoing example, the maximum resolution is 1024×768 dots and, when data is displayed by 640×480 dots on the display panel of the maximum resolution, the display controller 11 has only to transfer data for 480 lines of 768 lines and to transfer data of 640 dots of 1024 dots for each of the 480 lines. Therefore, when data of 640×480 dots is displayed on the display panel of 1024×768 dots, the display controller 11 has only to operate in timing necessary for displaying the data of 640×480 dots.

When all pixels of two or more continuous display lines belong to the non-display area as in the area C, the specific color data is set to all the source drivers SD1 to SD8, and these source drivers repeatedly output the same specific color data to all the display lines of the area C. If the same data is repeatedly output without updating the specific color data for each display line, the scan timing of the display lines can be quickened.

FIG. 14 shows a relationship between the resolution of data displayed on a 1024×768 panel and the number of colors of the displayed data.

As is seen from FIG. 14, data cannot be displayed on the conventional 1024×768 panel when the resolution is 800×600 and the number of colors is 16M and when the resolution is 640×480 and the number of colors is 16M, but can be done on the 1024×768 panel of the present invention.

As described above in detail, according to the present invention, when the various types of color data is displayed at a resolution lower than the maximum displayable resolution, a display controller is operated at lower speed than when the data is displayed at the maximum displayable resolution, with the result that the maximum number of colors of the data displayed at the lower resolution can be increased more than that of colors of data displayed at the maximum resolution.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

For example, the specific color is freely changed. Although the above embodiment adopts black as the specific color, the specific color is not limited to this color and thus blue, yellow, or the like can be adopted. In the above embodiment, data is displayed on 1024×768 panel at the resolution of 640×480 dots, but in principle another combination of resolutions is possible. Furthermore, the present invention can be applied to not only the TFT LCD panel but also another LCD panel such as an STN (Super Twisted Nematic) LCD panel and a flat display panel other than the LCD panel, such as a plasma display panel, an EL (Electronic Luminescence) display panel and an FED (Field Emission Display) panel. Moreover, the driver controller 113 shown in FIG. 8 can be provided on the body of the computer.

I claim:

1. A flat panel display device comprising:

a display panel including a plurality of pixels arranged in matrix of rows and columns;

a data latch circuit for latching various types of color data to be displayed on a display area having a predetermined resolution on said display panel;

a specific color data generation circuit for generating specific color data to be displayed on a non-display area on said display panel; and a timing control circuit for controlling timing such that the specific color data generated from said specific color data generation circuit is displayed on the non-display area simultaneously with an operation of displaying the various types of color data latched by said data latch circuit on the display area.

2. The device according to claim 1, wherein said timing control circuit starts to display the specific color data on the non-display area simultaneously with the start to display the various types of color data on the display area.

3. The device according to claim 1, wherein said timing control circuit includes means for detecting a resolution of the display area on said display panel.

4. The device according to claim 3, wherein said timing control circuit includes means for recognizing a boundary between the display area and the non-display area on said display panel based on the resolution detected by said resolution detecting means.

5. The device according to claim 1, wherein said display panel includes a plurality of column drivers for driving a plurality of column electrodes of said display panel and a plurality of row drivers for scanning row electrodes of said display panel for each of rows.

6. The device according to claim 5, wherein said plurality of row drivers scan continuous display lines of the non-display area to which all the pixels belong, at a higher speed than display lines of the display area.

7. The device according to claim 5, wherein each of said plurality of column drivers includes means for generating the specific color data.

8. The device according to claim 7, further comprising means for changing the specific color data generated from said specific color data generating means.

9. The device according to claim 5, wherein said timing control circuit includes means for causing column drivers of said plurality of column drivers, which correspond to the non-display area, to display the specific color data on the non-display area.

10. The device according to claim 5, wherein said timing control circuit includes means for supplying each of the plurality of column drivers with a first control signal indicating whether the specific color data is to be displayed.

11. The device according to claim 10, wherein each of said plurality of column drivers includes means for determining whether the specific color data is to be displayed in response to the first control signal.

12. The device according to claim 5, wherein said timing control circuit includes means for causing only column drivers of said plurality of column drivers, which correspond to the display area, to display the various types of color data in sequence on the display area.

13. The device according to claim 5, wherein said timing control circuit includes means for supplying each of the plurality of column drivers with a second control signal indicating whether an enable signal received from a preceding column driver is to be transferred to a succeeding column driver.

14. The device according to claim 13, wherein each of said plurality of column drivers includes means for determining whether the enable signal received from the preceding column driver is to be transferred to the succeeding column driver, in response to the second control signal.

15. The device according to claim 1, wherein the specific color data to be displayed on the non-display area is black data.

16. A method of displaying color data on a display panel including a plurality of pixels arranged in matrix of rows and columns, comprising the steps of:

latching various types of color data to be displayed on a display area having a predetermined resolution on said display panel;

generating specific color data to be displayed on a non-display area on said display panel; and controlling timing such that the specific color data is displayed on the non-display area simultaneously with an operation of displaying the various types of color data latched on the display area.

17. The method according to claim 16, further comprising a step of starting to display the specific color data on the non-display area simultaneously with the start to display the various types of color data on the display area.

18. The method according to claim 16, further comprising a step of detecting a resolution of the display area on said display panel.

19. The method according to claim 18, further comprising a step of recognizing a boundary between the display area and the non-display area on said display panel based on the detected resolution.

20. The method according to claim 16, further comprising a step of scanning continuous display lines of the non-display area to which all the pixels belong, at a higher speed than display lines of the display area.

* * * * *